US008238771B2

(12) United States Patent
Murakami

(10) Patent No.: US 8,238,771 B2
(45) Date of Patent: Aug. 7, 2012

(54) IMAGE FORMING APPARATUS HAVING PAPER-TYPE DETECTING UNIT

(75) Inventor: Reiji Murakami, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1003 days.

(21) Appl. No.: 12/206,346

(22) Filed: Sep. 8, 2008

(65) Prior Publication Data

US 2009/0074435 A1 Mar. 19, 2009

Related U.S. Application Data

(60) Provisional application No. 60/972,233, filed on Sep. 13, 2007.

(51) Int. Cl.
*G03G 15/00* (2006.01)

(52) U.S. Cl. ..... 399/45

(58) Field of Classification Search ..... 399/45, 399/389

See application file for complete search history.

(56) References Cited

U.S. PATENT DOCUMENTS 5,486,903 A * 1/1996 Kanno et al. ..... 399/45

FOREIGN PATENT DOCUMENTS

JP 2005-038277 2/2005
JP 2005-202177 7/2005

OTHER PUBLICATIONS

Uekawa et al. (JP 2005-202177 A), JPO Machine Translation.*

* cited by examiner

*Primary Examiner* — David Gray
*Assistant Examiner* — Erika J Villaluna
(74) *Attorney, Agent, or Firm* — Patterson & Sheridan, LLP

(57) ABSTRACT

An image forming apparatus having a paper-type detecting unit includes a paper-type detecting unit that detects a paper type of a sheet to be printed, a fixing unit that sets fixing temperature on the basis of the paper type detected by the paper-type detecting unit and fixes a toner image on the sheet, a paper-type-detection-failure determining unit that determines that the paper-type detecting unit is in failure, a paper-type-during-failure setting unit that sets in advance a paper type having a high frequency of use as a paper type during a failure according to a region, and a printing-during-failure selecting unit which is selectably provided, when the paper-type-detection-failure determining unit determines that the paper-type detecting unit is in failure, whether a printing condition for the paper type set by the paper-type-during-failure setting unit is set or it is determined that the paper type is a paper type of a sheet printed immediately before the failure and a printing condition is continued.

11 Claims, 7 Drawing Sheets

IMAGE FORMING APPARATUS HAVING PAPER-TYPE DETECTING UNIT

CROSS-REFERENCE TO RELATED APPLICATION

This application is based upon and claims the benefit of priority from U.S. Provisional Application No. 60/972,233 filed on Sep. 13, 2007, the entire contents of which are incorporated herein by reference.

TECHNICAL FIELD

The present invention relates to an image forming apparatus, and, more particularly to an image forming apparatus having a paper-type detecting unit.

BACKGROUND

Conventionally, in image forming apparatuses such as a multifunction color copying apparatus (an MFP), types of media on which color image and the like are printed increase. Even when printing media are limited to paper, various types of paper having different thicknesses and the like are used.

Such types of paper are usually distinguished by basis weight (unit: g/m$^2$) indicating weight per a fixed are. For example, papers in groups of basis weights 64 to 105, 106 to 163, 164 to 209, 210 to 256, and 257 to 300 are called plain paper, thick paper 1, thick paper 2, thick paper 3, and thick paper 4. These basis weights are usually written on packages of sheets. A user selects one of the groups of the written basis weights, whereby a printing condition corresponding to a type of paper belonging to the selected group is automatically set. In general, it is desirable to change a printing condition according to basis weight. However, basis weight may be unknown. In such a case, it is difficult to easily detect basis weight. It is possible to calculate basis weight from the density and thickness of a sheet. Although it is difficult to measure the density of a sheet, the measurement of paper thickness is relatively easy compared with the measurement of density. Therefore, there is known a device that detects paper thickness in order to learn a paper type and the like.

Such a paper thickness detecting device detects paper thickness in any case. A paper type is estimated from the paper thickness. However, for example, when a device for detecting a paper type such as the paper thickness detecting device is in failure, it may be difficult to detect a paper type. In such a case, there is a problem concerning how a failure of the paper-type detecting device (a media sensor) should be determined. There is also a problem concerning, when a paper type cannot be determined, how a paper type is estimated to perform image formation.

Concerning the determination of a failure of a media sensor, for example, Japanese patent disclosure JP-A-2005-202177 discloses an image forming apparatus that determines a failure of a media sensor on the basis of a media feature value. The image forming apparatus determines that the media sensor is in failure when a feature value S of a medium detected by the media sensor deviates from a range from a detection upper limit value Smax to a detection lower limit value Smin set in advance and performs image formation according to a control mode during a failure set in advance.

Concerning the selection of a paper type in the case of a failure of the media sensor, for example, Japanese patent disclosure JP-A-2005-38277 discloses an image forming apparatus that determines a paper type on the basis of a history of use of sheets in the past. The image forming apparatus stores a history of use of sheets (media), determines, when latest media information cannot be acquired, a type of a medium with a highest frequency of use with reference to the history in the past, and performs processing for print data according to the type.

However, in the determination of a failure of the media sensor, it is unclear in what kind of state a feature value of a medium is measured and it is not easy to determine whether the media sensor is in failure. In the selection of a paper type, a storage device for always storing a history of use of sheets in the past is separately required, which is likely to lead to an increase in cost

SUMMARY

The present invention has been devised in view of the above points and it is an object of the present invention to provide an image forming apparatus having a paper-type detecting device that can perform satisfactory printing even when a paper type cannot be detected by paper-type detecting means and is low in cost.

According to an aspect of the present invention, there is provided an image forming apparatus having a paper-type detecting unit, the apparatus including a paper-type detecting unit that detects a paper type of a sheet to be printed, a fixing unit that sets fixing temperature on the basis of the paper type detected by the paper-type detecting unit and fixes a toner image on the sheet, a paper-type-detection-failure determining unit that determines that the paper-type detecting unit is in failure, a paper-type-during-failure setting unit that sets in advance a paper type having a high frequency of use as a paper type during a failure according to a region, and a printing-during-failure selecting unit which is selectably provided, when the paper-type-detection-failure determining unit determines that the paper-type detecting unit is in failure, whether a printing condition for the paper type set by the paper-type-during-failure setting unit is set or it is determined that the paper type is a paper type of a sheet printed immediately before the failure and a printing condition is continued.

DETAILED DESCRIPTION

An embodiment of the present invention is explained in detail below with reference to the accompanying drawings. In the following explanation, it is assumed that an image forming apparatus according to the embodiment is a multifunction color copying apparatus.

The present invention is characterized by how a failure in a paper-thickness detecting device as well as a paper-type detecting device is determined and how a paper type is estimated when these devices are in failure. In the embodiment of the present invention described below, a voltage detecting unit determines whether a failure occurs according to whether an output voltage V0 of a voltage detecting circuit before sheet insertion and a differential voltage V0-V1 calculated from the output voltage V0 and an output voltage V1 after the insertion of the sheet are within predetermined voltage ranges. When it is determined that a failure occurs, if a paper type during a failure is set, the image forming apparatus uses the paper type, and, if the paper type during a failure is not set, the image forming apparatus causes a user to select a paper type.

Figure 1:
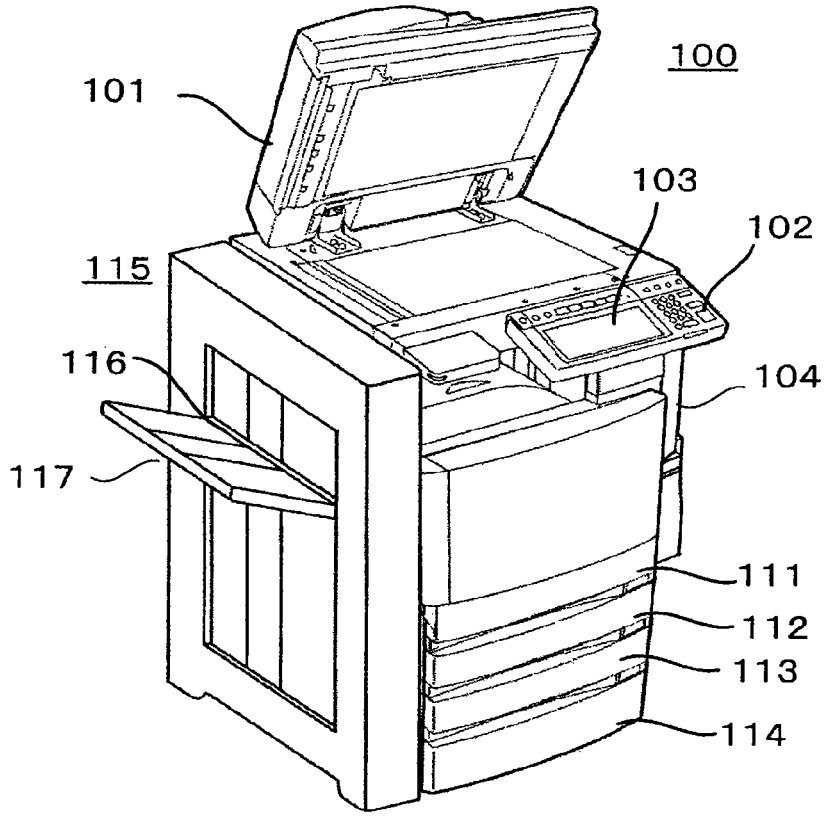
FIG. 1 is a perspective view showing an overview of a multifunction color copying apparatus (an MFP) according to an embodiment of the present invention.

FIG. 1 is a perspective view showing an example of an external appearance of the multifunction color copying machine according to this embodiment. An automatic document feeder (ADF) 101 that also serves as an original cover and automatically feeds sheet-like originals one by one is openably and closably provided in an upper part of an apparatus main body 100. An operation panel 102 including various operation keys for instructing a copy condition and the start of copying, various display devices, and the like is provided in a front section on an upper surface of the apparatus main body 100. Various setting and registration buttons (not shown) are also provided in the operation panel 102. A touch panel display 103 on which various kinds of information for the user are displayed and with which, when the user is requested to input information, the user can perform predetermined input by touching the same is provided beside the operation panel 102.

A handle 104 is provided below the operation panel 102 on a front surface of the apparatus main body 100 to allow the user to open the inside of the main body when, for example, a paper jam occurs.

Paper feeding cassettes 111, 112, 113, and 114 are detachably provided in a lower part of the apparatus main body 100. Sheets of different sizes and paper types are stored in the paper feeding cassettes, respectively.

A post-processing apparatus 115 is attached on the left side of the apparatus main body 100. In the apparatus main body 100, a latent image described later is formed, printed, and fixed on a sheet. The sheet is subjected to processing such as aligning and stapling in the post-processing apparatus 115 and discharged from a sheet discharge port 116. The sheet discharged from the sheet discharge port 116 is stacked on a stacking tray 117.

Figure 2:
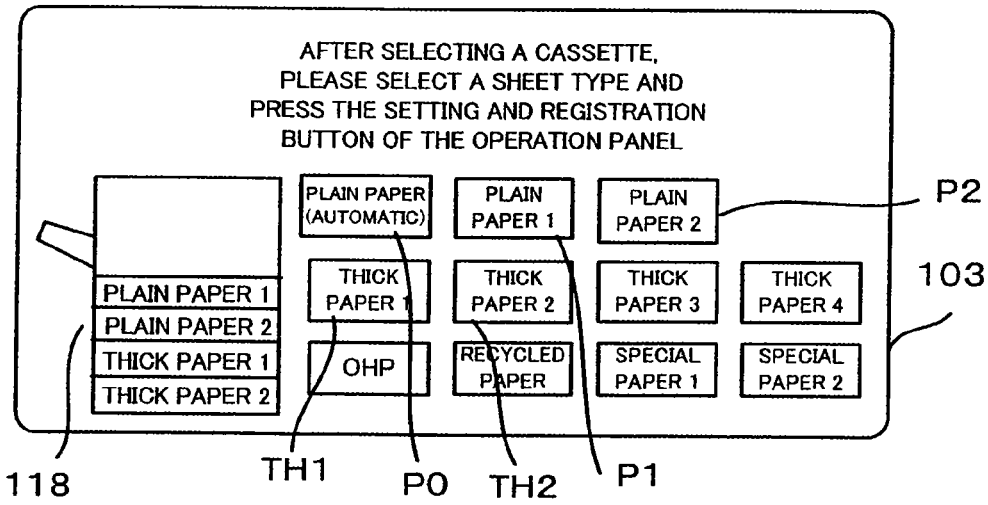
FIG. 2 is a diagram showing an example of a display screen on a touch panel display 103 of an operation panel 102 during input of basis weight.

When the user presses a setting and registration button of the operation panel 102, first, a general setting registration screen is displayed on the touch panel display 103. When the user clicks a sheet setting icon of this screen, a sheet setting screen shown in FIG. 2 is displayed. A main body side icon 118 is displayed on the left side of this screen. Buttons P0, P1, and P2 for plain paper (automatic), plain paper 1, and plain paper 2 are arrayed and displayed at a first stage on the right of the main body side icon 118. Buttons for four kinds of thick paper, i.e., thick paper 1, thick paper 2, thick paper 3, and thick paper 4 are displayed at a second stage. Buttons corresponding to types of sheets other than plain paper and the thick paper are displayed at a third stage.

Above these kinds of display, a guidance "after selecting a cassette, please select a paper type and press the setting and registration button of the operation panel" is displayed. According to this guidance, the user touches any one of paper feeding cassettes of the main body side icon 118, then, touches an icon of a paper type displayed on the right side, and selects a paper type stored in the selected paper feeding cassette. By repeating this operation, paper types are displayed in respective paper feeding cassette positions of the main body side icon 118. When the user presses the setting and registration button of the operation panel 102, a correspondence relation between the paper feeding cassettes and the paper types stored in the paper feeding cassettes is stored in a cassette-sheet-correspondence recognizing unit 122, which is described later.

Figure 3:
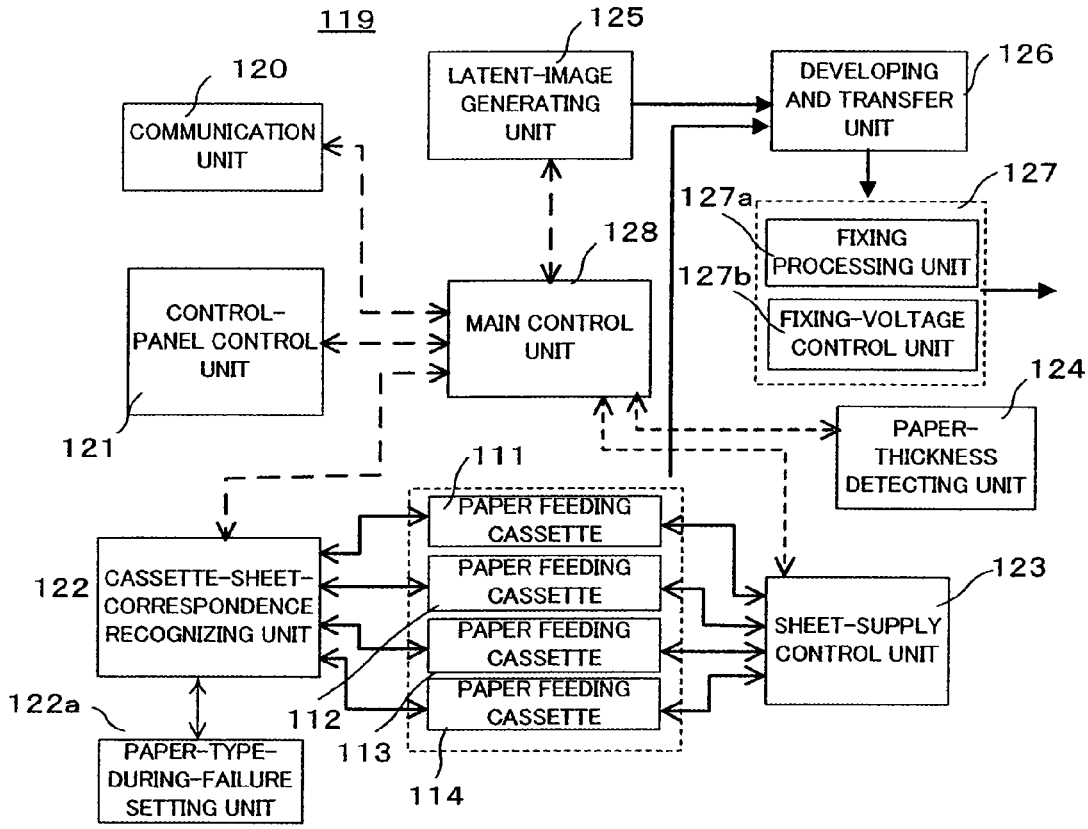
FIG. 3 is a diagram showing an electric schematic configuration of the entire MFP according to the embodiment.

An electric schematic configuration of the multifunction color copying apparatus according to this embodiment shown in FIG. 1 is shown in FIG. 3. This MFP 119 includes a communication unit 120 connected to the outside through a network, a control-panel control unit 121 that controls an entire control panel including the operation panel 102 and the touch panel display 103 shown in FIG. 1, a cassette-sheet-correspondence recognizing unit 122 that recognizes in advance paper types stored in the paper feeding cassettes 111, 112, 113, and 114, a sheet-supply control unit 123 that supplies, according to a type of a sheet inputted to the touch panel display 103 as explained with reference to FIG. 2, a sheet of the type, a paper-thickness detecting unit 124 that accurately detects the thickness of the sheet supplied by the sheet-supply control unit 123, a latent-image generating unit 125 that scans an original in performing copying or the like in the MFP 119 and generates, for example, an electrostatic latent image, a developing and transfer unit 126 that develops the latent image generated by the latent-image generating unit 125 using, for example, a toner and transfers a toner image formed by the development onto a predetermined sheet, a fixing unit 127 that fixes the transferred image with a predetermined voltage, and a main control unit 128 that controls the respective units. The fixing unit 127 includes a fixing processing unit 127*a* that applies image fixing processing to the predetermined sheet and a fixing-temperature control unit 127*b* that controls fixing temperature in performing the fixing processing.

A paper-type-during-failure setting unit 122*a* is connected to the cassette-sheet-correspondence recognizing unit 122. The paper-type-during-failure setting unit 122*a* sets in advance whether a printing condition for the plain paper 1 is set or a printing condition for the plain paper 2 is set when the paper-thickness detecting unit 124 described later is in failure.

The plain paper includes relatively thick plain paper and relative thin plain paper. In these kinds of plain paper, when it is assumed that density is fixed, basis weight changes. As described above, in the plain paper, the basis weight is in a range of, for example, 64 g/m$^2$ to 105 g/m$^2$. The range is relatively wide. In general, the relatively thin plain paper is used in Japan and the relatively thick plain paper is used in countries other than Japan.

As described below, besides an icon of the plain paper (automatic), icons of the plain paper 1 and the plain paper 2 are displayed on a display screen of the touch panel display 103 shown in FIG. 2. In the case of the plain paper 1, toner image fixing processing is performed at relatively low first fixing temperature. In the case of the plain paper 2, the fixing processing is performed at relatively high second fixing temperature.

Therefore, when the multifunction color copying apparatus (the MFP) according to this embodiment is used in Japan, the paper-type-during-failure setting unit 122*a* sets a paper type such that the fixing processing is performed at relatively low temperature in the same manner as the fixing processing performed when the plain paper 1 is selected as a paper type during a failure. On the other hand, when the MFP is used in countries other than Japan, the paper-type-during-failure setting unit 122*a* sets a paper type such that the fixing processing is performed at relatively high temperature in the same manner as the fixing processing performed when the plain paper 2 is selected as a paper type during a failure.

When the plain paper (automatic) is selected separately from the plain paper 1 and the plain paper 2 displayed on the touch panel display 103 and when it is determined that the paper-thickness detecting unit 124 is in failure, it is also possible to set automatic plain paper 1 and automatic plain paper 2 different from the plain paper 1 and the plain paper 2. In this case, there is an advantage that fixing temperature and the like in the case of the automatic plain paper 1 and the automatic plain paper 2 can be set different from temperature set when the plain paper 1 and the plain paper 2 are selected.

After a toner image is transferred onto a sheet by the developing and transfer unit 126, fixing processing for the toner image is performed by the fixing processing unit 127*a* of the fixing unit 127. The temperature for the fixing processing is controlled by the fixing-voltage control unit 127*b*. An icon P1 of the plain paper 1 and an icon P2 of the plain paper 2 are associated with the fixing-temperature control unit 127*b*.

When the plain paper 1 is selected, the fixing-voltage control unit 127*b* controls fixing temperature as a printing condition such that fixing temperature in the fixing unit 127 is set within a range from about 150° C. to about 175° C. (first fixing temperature). On the other hand, when the plain paper 2 is selected, the fixing-voltage control unit 127*b* controls fixing temperature as a printing condition such that fixing temperature in the fixing unit 127 is set within a range from about 160° C. to about 180° C. (second fixing temperature) A user reads a manual of the MFP and touches the icon of the plain paper 1 or the plain paper 2. When the user cannot decide which of the plain paper 1 and the plain paper 2 should be selected, the user touches the icon of the plain paper (automatic).

Figure 4:
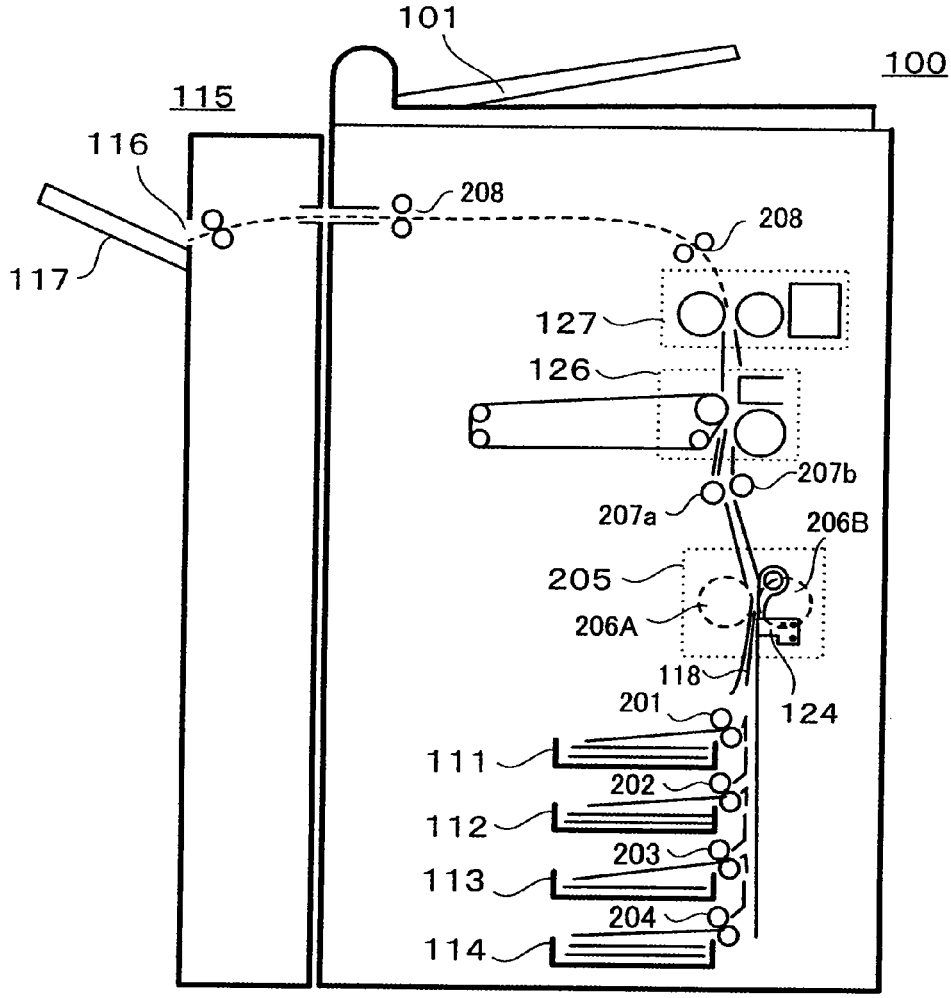
FIG. 4 is a diagram showing the schematic structure in which a process of supply of a sheet, printing on the sheet, and discharge of the sheet in the MFP according to the embodiment is drawn.

A schematic structure of the MFP according to this embodiment in which a flow of a sheet is mainly drawn is shown in FIG. 4.

The plain paper 1, the plain paper 2, the thick paper 1, and the thick paper 2 are stored in the paper feeding cassettes 111, 112, 113, and 114. The sheets stored in the paper feeding cassettes are selectively extracted one by one by paper feeding rollers 201, 202, 203, and 204 as required and fed to a paper-thickness detecting and conveying unit 205. A circuit that drives the paper feeding rollers 201, 202, 203, and 204 is also included in the sheet-supply control unit 123 shown in FIG. 3.

The paper-thickness detecting and conveying unit 205 includes, as described later, the paper-thickness detecting unit 124 that detects the thickness of the conveyed sheet 118, two pairs of conveying rollers for conveying the sheet, i.e., two conveying driving rollers 206A and two conveying driven rollers 206B. The sheet, the thickness of which is detected by the paper-thickness detecting unit 124 of the paper-thickness detecting and conveying unit 205, is conveyed and aligned by a pair of registration rollers 207*a* and 207*b*. The sheet aligned by the registration rollers 207*a* and 207*b* is supplied to the developing and transfer unit 126. The electrostatic latent image generated by the latent-image generating unit 125 shown in FIG. 2 is developed by the developing and transfer unit 126 with a toner and transferred onto the conveyed sheet.

The sheet having the toner image transferred thereon is subjected to image fixing processing, i.e., printing by the fixing unit 127. The printed sheet is discharged from the apparatus main body 100 through several pairs of conveying rollers 208 and enters the post-processing apparatus 115. The sheet that enters the post-processing apparatus 115 is subjected to various post processing such as stapling (not shown) in the post-processing apparatus 115, discharged from the sheet discharge port 116, and stacked on the stacking tray 117.

Figure 5:
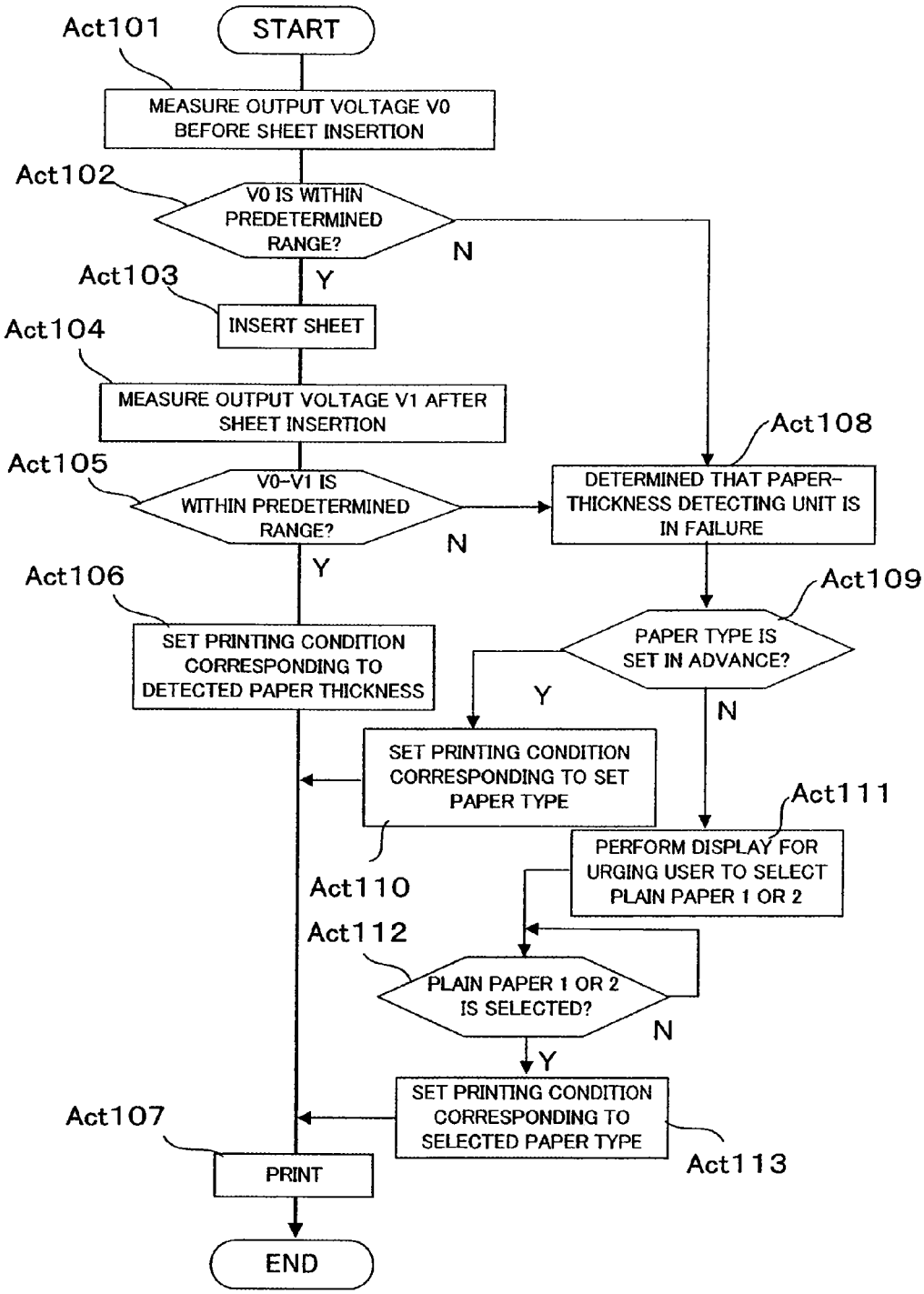
FIG. 5 is a flowchart for explaining operations of the MFP according to the embodiment.

A flowchart of operations according to this embodiment in selecting the plain paper (automatic) in the multifunction color copying apparatus is shown in FIG. 5. When it cannot be decided whether plain paper suitable for printing is the plain paper 1 or the plain paper 2, the user presses an icon P0 of the plain paper (automatic) on the display screen of the touch panel display 103 shown in FIG. 2. Then, as described later in detail, the paper-thickness detecting unit 124 measures paper thickness of the conveyed sheet as a voltage to thereby determine whether the plain paper 1 or the plain paper 2 is suitable as the plain paper.

When the user touches the icon of the plain paper (automatic), in Act 101, before the sheet 118 is conveyed to the paper-thickness detecting unit 124, the paper-thickness detecting unit 124 measures a detected voltage V0 before sheet insertion. In Act 102, the paper-thickness detecting unit 124 detects whether the detected voltage V0 before sheet insertion is within a predetermined voltage range. When the voltage V0 is within the predetermined voltage range, in Act 103, a sheet is inserted. In Act 104, the paper-thickness detecting unit 124 measures a detected voltage V1 after sheet insertion.

In Act 105, the paper-thickness detecting unit 124 determines whether a voltage obtained by subtracting the detected voltage V1 after sheet insertion from the detected voltage V0 before sheet insertion, i.e., a differential voltage V0-V1 is within a predetermined voltage range. When the differential voltage V0-V1 is within the predetermined voltage range, in Act 106, the paper-thickness detecting unit 124 detects paper thickness substantially proportional to the differential voltage and sets a printing condition corresponding to the paper thickness. Thereafter, printing is performed in Act 107.

Automatic detection of paper thickness by the paper-thickness detecting and conveying unit 205 shown in FIG. 3 in the apparatus according to this embodiment is explained in detail.

Figure 6:
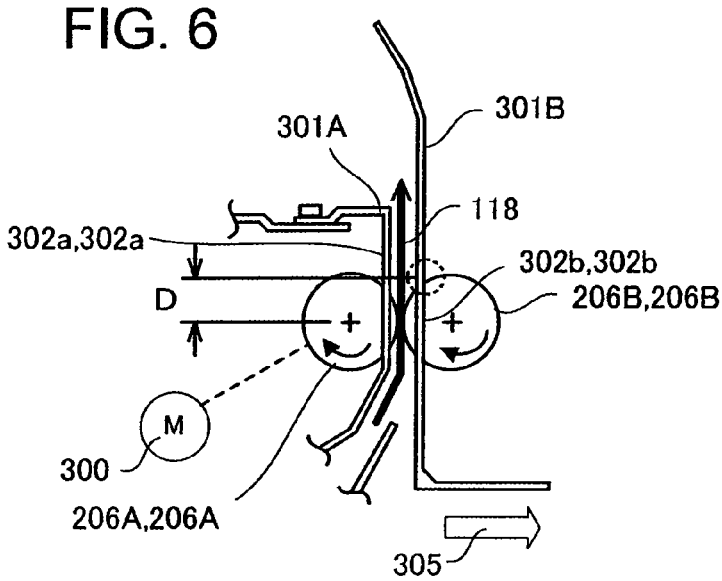
FIG. 6 is a diagram for explaining a relation between a conveying driving mechanism and a paper-thickness detecting mechanism in the embodiment.

The sectional structure of the paper-thickness detecting and conveying unit 205 is shown in FIG. 6. The conveying driving rollers 206A are rollers, at least peripheral surfaces of which are formed by, for example, rubber. The conveying driving rollers 206A are driven to rotate by a conveying driving motor 300. The conveying driven rollers 206B are rollers, peripheral surfaces of which are formed by, for example, plastic. The conveying driven rollers 206B rotate according to the rotation of the conveying driving rollers 206A.

The sheet passes between a conveyance guide 301A and a conveyance guide 301B. Schematically, the conveyance guide 301A is formed in a reverse L shape in section. The conveyance guide 301B is formed in an L shape in section. The sheet 118 is conveyed upward by the conveying driving rollers 206A and the conveying driven rollers 206. The conveyance guide 301B is configured to be movable in a lateral direction, i.e., a direction of an arrow 305 such that, when the sheet 118 jams during the conveyance, the sheet 118 can be easily removed.

Figure 7:
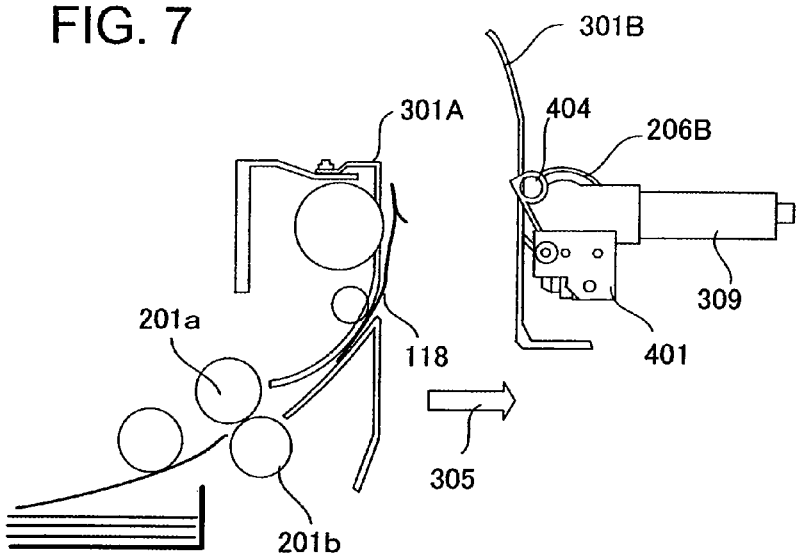
FIG. 7 is a diagram for explaining that it is possible to separate a conveyance guide 301B and the like from a conveyance guide 301A and the like in the lateral direction in the embodiment.

A sectional view in which the conveyance guide 301B and the conveying driven rollers 206B are separated from the conveyance guide 301A and the conveying driving rollers 206A is shown in FIG. 7. A perspective view in a state in which the conveying driven rollers 206B are separated in the lateral direction from the conveyance guide 301B is shown in FIG. 8.

Openings 302*a* are provided in the conveyance guide 301A. Openings 302*b* are provided in the conveyance guide 301B. The conveying driving rollers 206A and the conveying driven rollers 206B are set in contact with each other through the openings 302*a* and the openings 302*b*. When the sheet 118 is fed from the paper feeding cassettes 111 to 114, the sheet 118 is nipped by the conveying driving rollers 206A and the conveying driven rollers 106B and conveyed in an arrow direction (upward). As described later, the thickness of the sheet is detected by the paper-thickness detection unit 124 during the conveyance.

Figure 8:
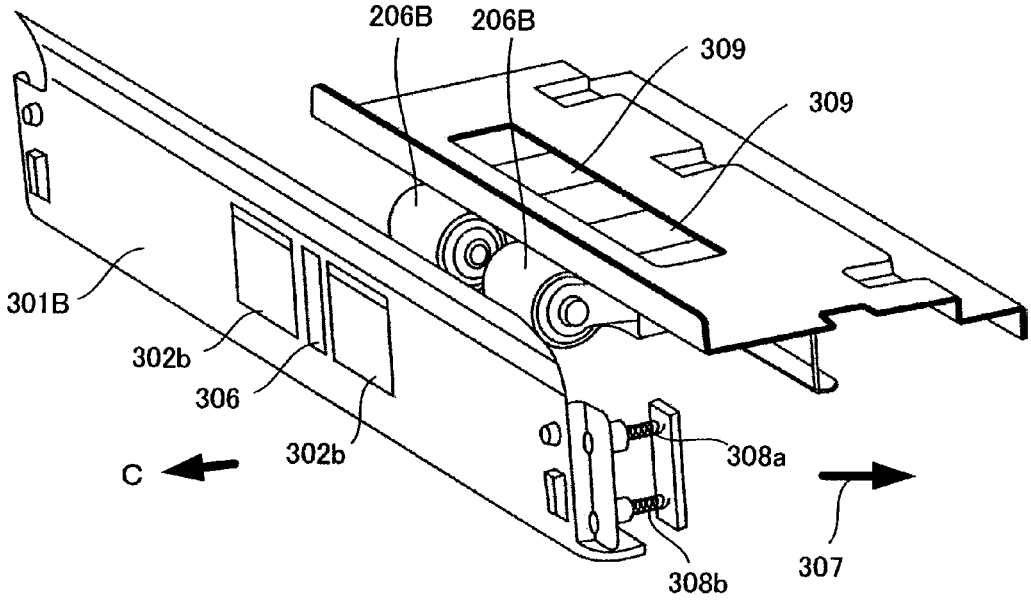
FIG. 8 is a diagram for explaining that it is possible to further separate a conveying driven roller and the like from the conveyance guide 301B in the embodiment.

An opening 306 provided between the two openings 302*b* of the conveyance guide 301B shown in FIG. 8 is an opening for bringing a bearing 404 (shown in FIG. 7) of the paper-thickness detecting unit 124 described later into contact with the sheet 118.

As shown in FIG. 7, the conveyance guide 301B and the conveyance driven rollers 206B can be separated from the conveyance guide 301A and the conveying driving rollers 206A. For example, when the sheet 118 jams near somewhere between the conveying driving rollers 206A and the conveying driven rollers 206B, it is possible to separate the conveyance guides 301A and 301B as described above and remove the sheet.

As shown in FIG. 8, the conveyance guide 301B is attached to the main body and pressed in an arrow C direction by, for example, pressing springs 308*a* and 308*b*. On the other hand, the conveying driven rollers 206B and a holding mechanism 309 therefor are provided independently from the conveyance guide 301B and the like. This is for the purpose of preventing, as much as possible, vibration or the like of the main body described later from being transmitted to the bearing 404 of the paper-thickness detecting unit 124 and affecting paper thickness detection.

Figure 9:
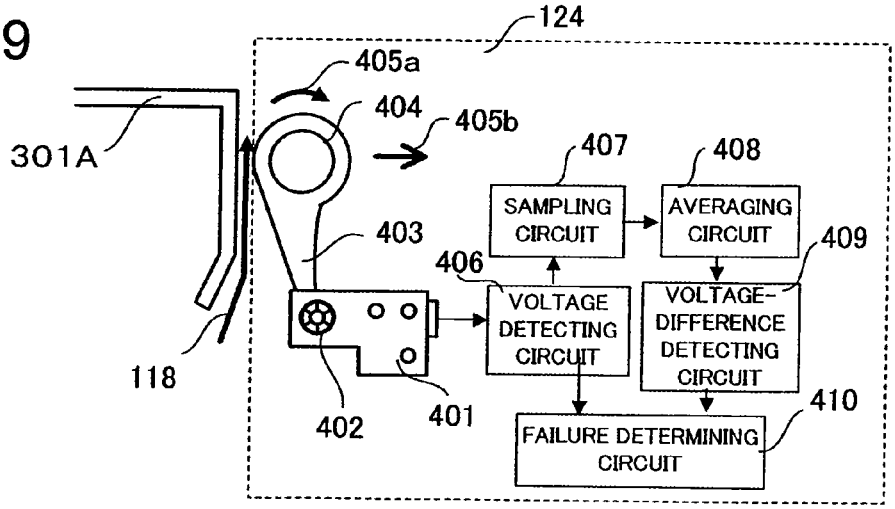
FIG. 9 is a diagram showing a configuration of a paper-thickness detecting unit 124 according to the embodiment.
Figure 10:
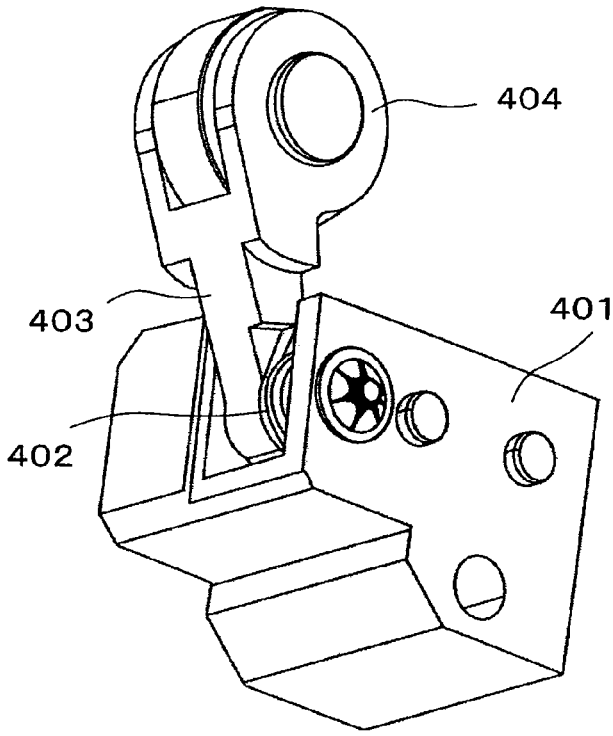
FIG. 10 is a perspective view showing the structure of a resistance-change detecting module 401, an arm 403, and a bearing 404 in the paper-thickness detecting unit 124.

An overall configuration of the paper-thickness detecting unit 124 is shown in FIG. 9. The paper-thickness detecting unit 124 includes a resistance-change detecting module 401, an arm 403 that pivots around a fulcrum 402 of the resistance-change detecting module 401, the bearing 404 provided at a distal end of the arm 403, a voltage detecting circuit 406, a sampling circuit 407, an averaging circuit 408, a voltage-difference detecting circuit 409, and a failure determining circuit 410. FIG. 10 is a perspective view showing the structure of the resistance-change detecting module 401, the arm 403, and the bearing 404.

The bearing 404 is pressed in a direction of the conveyance guide 301A and the conveying driving rollers 206A with predetermined pressure by a not-shown spring or the like. A pressing load P of the spring is, for example, 100 g. As shown in FIG. 6, a contact position of the sheet 118 and the bearing 404 is provided on a downstream side of a nip point of the conveying driving rollers 206A and the conveying driven rollers 206B. A distance D between the nip point of the conveying driving rollers 206A and the conveying driven rollers 206B and the contact position of the sheet 118 and the bearing 404 is, for example, about 6 mm.

If the pressing load P is too large, when the sheet 118 enters between the conveyance guide 301A and the conveyance guide 301B, the sheet 118 buckles without being smoothly conveyed. When the pressing load P is too small, the bearing 404 is not properly brought into contact with the sheet 118. The bearing 404 tends to be separated from the sheet 118 by the vibration of the driving system. The bearing 404 also separates from the sheet 118 because of the shock of the entrance of the sheet 118. Therefore, it is difficult to measure accurate thickness of the sheet 118 if the pressing load P is too low.

When the distance D is too large, a position where the bearing 404 comes into contact with the sheet 118 is away from a position where the sheet 118 is driven to be conveyed, i.e., a contact position of the conveying driving rollers 206A and the conveying driven rollers 206B. Since the bearing 404 does not have a function of conveying the sheet 118, even in such a situation, sheet conveying force is small in the position where the bearing 404 comes into contact with the sheet 118. As a result, normal conveyance of the sheet 118 tends to be difficult. In this way, in general, the sheet conveying force by the conveying driving rollers 206A and the conveying driven rollers 206B, the pressing load P of the bearing 404, and the distance D are related.

Therefore, although the pressing load P of the bearing 404 is different depending on a material, the structure, and the like of the bearing 404, the sheet conveying force, and the like, usually, the pressing load P only has to be about 60 g to 140 g and is preferably about 80 g to 120 g. Although the distance D is different depending on the length of a contact section of the conveying driving rollers 206A and the conveying driven roller 206B, the conveying force, and the like, usually, the distance D only has to be about 0 mm to 10 mm and is preferably in a range from about 2 mm to 8 mm.

When the sheet 118 is conveyed along the conveyance guide 301A, the bearing 404 rotates in a direction indicated by an arrow 405*a*. The arm 403 shifts, i.e., pivots in a direction indicated by an arrow 405*b* because of the thickness of the sheet 118. A magnet is provided near a fulcrum of the arm 403. A magnetic resistance sensor that uses magnetic resistance, a resistance value of which changes according to a change in a magnetic field, is provided near the magnet.

An electric signal output of the magnetic resistance sensor is inputted to the voltage detecting circuit 406. An output voltage of the voltage detecting circuit 406 is sampled, for example, ten times by the sampling circuit 407. The output voltage is sampled and sampled values are averaged because, when the bearing 404 is moved in a direction indicated by an arrow 405*b* by the vibration of the apparatus or the conveyance of the sheet 118, a value of the magnetic resistance changes and the output voltage of the voltage detecting circuit 406 changes.

Voltage values sampled by the sampling circuit 407 are averaged by the averaging circuit 408 and inputted to the voltage-difference detecting circuit 409. The voltage-difference detecting circuit 409 detects a difference in the averaged voltage value. This voltage difference corresponds to the thickness of the sheet 118. The magnetic resistance of the magnetic resistance sensor acts in a direction in which the resistance value decreases when the sheet 118 is conveyed to the paper-thickness detecting unit 124. The output voltage value of the voltage detecting circuit 406 decreases.

A voltage value detected by the voltage detecting circuit 406 is set to 1 mV with respect to the thickness 1 μm of the sheet 118. Usually, since the thickness of plain paper is about 100 μm, the output voltage is detected as about 100 mV for the plain paper. For example, if the voltage V0 before sheet passage is 3.3 V and the thickness of paper is large around about 1.35 V, the voltage value changes in a decreasing direction.

Figure 11:
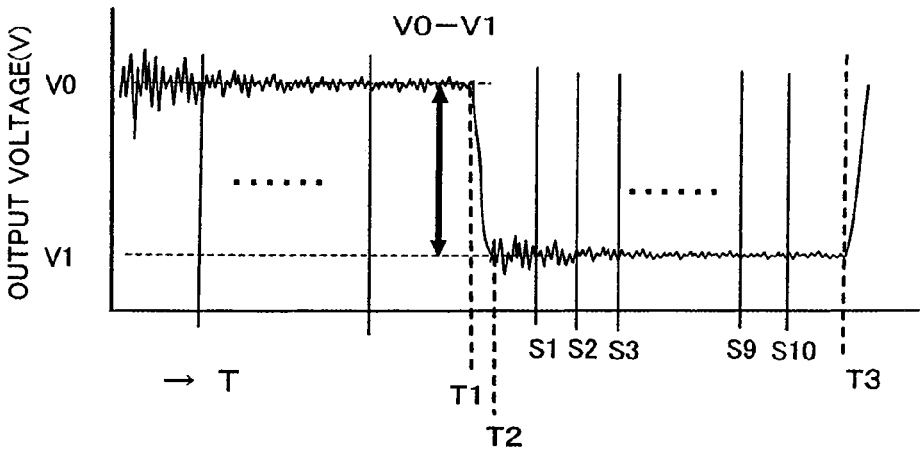
FIG. 11 is a diagram showing an example of an output voltage of a voltage detecting circuit 406 at the time when a sheet is fed into the paper-thickness detecting unit 124.

For example, when it is assumed that the sheet 118 is nipped by the bearing 404 from time T1 to T2 and the sheet 118 is conveyed and returns to an original state at time T3, as shown in FIG. 11, the voltage detecting circuit 406 outputs a voltage of about V0 when the sheet 118 is not present. Even in this state, an output value fluctuates because of the vibration of the apparatus and the like. Fluctuating output voltage values are sampled by the sampling circuit 407 and the sampling values are averaged by the averaging circuit 408. The averaged voltage value is sent to the voltage-difference detecting circuit 409. V0 is once stored as a voltage value at the time when the sheet 118 is not conveyed to the paper-thickness detecting unit 124.

At time T1, the sheet 118 is conveyed to the paper-thickness detecting unit 124, the sheet 118 is nipped by the bearing 404 and the conveyance guide 301A, and the bearing 404 rotates as indicated by an arrow 405*a* and pivots as indicated by an arrow 405*b*. At this point, a value of the magnetic resistance in the magnetic resistance sensor decreases. After time T2, the output value of the voltage detecting circuit 406 falls below V0 as shown in FIG. 9.

Even in a state in which the sheet 118 is nipped by the bearing 404 and the conveyance guide 301A and moves, the bearing 404 is moved by the movement of the sheet 118 and the vibration of the apparatus. According to the movement of the bearing 404, the output voltage value of the voltage detecting circuit 406 fluctuates. The fluctuating voltage values are sampled, for example, ten times by the sampling circuit 407 and averaged by the averaging circuit 408. An average value of the voltage values is inputted to the voltage-difference detecting circuit 409 as a voltage value V1 in a state in which the sheet 118 is inserted.

The voltage-difference detecting circuit 409 outputs, as a voltage difference, a value obtained by subtracting the voltage value V1 from the voltage value V0 detected earlier. This value (V0-V1) corresponds to the thickness of the sheet 118. The thickness of the sheet 118 is detected. In this way, if paper thickness is detected as a difference of voltage values rather than a voltage value, it is possible to cancel an offset of voltages. A problem such as a change in a voltage value due to distortion by a conveyance guide is eliminated. Therefore, there is an advantage that paper thickness can be more accurately measured.

The failure determining circuit 410 has a not-shown comparator and stores an upper limit value V0max and a lower limit value V0min of the voltage V0 in advance. The voltage V0 detected by the voltage detecting circuit 406 before the sheet 118 enters the bearing 404 and the conveyance guide 301A is inputted to the failure determining circuit 410.

The failure determining circuit 410 compares, in the comparator, the voltage V0 with the upper limit value V0max and compares the voltage V0 with the lower limit value V0min. The failure determining circuit 410 determines whether the voltage V0 satisfies a condition V0max≧V0≧V0min. When the voltage V0 does not satisfy this condition, the failure determining circuit 410 determines that the paper-thickness detecting unit 124 is in failure.

The differential voltage V0-V1 is inputted to the failure determining circuit 410 from the voltage-difference detecting circuit 409. In the failure determining circuit 410, an upper limit value (V0-V1)max and a lower limit value (V0-V1)min of the differential voltage are also stored. The failure determining circuit 410 compares the differential voltage V0-V1 with the voltage values (V0-V1)max and (V0-V1)min. When the differential value V0-V1 is larger than the upper limit value (V0-V1) or smaller than the lower limit value (V0-V1) min, the differential voltage is not present between the upper limit value (V0-V1)max and the lower limit value (V0-V1) min. Therefore, the failure determining circuit 410 determines that the paper-thickness detecting unit 124 is in failure.

In this way, the failure determining circuit 410 has a function of determining whether the voltage value V0 of the voltage detecting circuit 406 before the sheet 118 enters and the differential voltage V0-V1 obtained by the voltage-difference detecting circuit 409 are within a predetermined range and, when the voltage value V0 and the differential voltage V0-V1 are not within the range, determining that the paper-thickness detecting unit 124 is in failure.

In this way, in the flowchart shown in FIG. 5, the determination on whether the paper-thickness detecting unit 124 is in failure from Act 102 to Act 108 and from Act 105 to Act 108 is performed by the failure-determining circuit 410.

When the voltage value V0 obtained before sheet insertion is not within the predetermined voltage range, i.e., when V0 is larger than the upper limit value V0max for normal operation or smaller than the lower limit value V0min for normal operation, the failure determining circuit 410 shifts to Act 108 and determines that the paper-thickness detecting unit 124 cannot detect paper thickness because of a failure or the like.

When the differential voltage V0-V1 is not within the predetermined range, i.e., the differential voltage V0-V1 is larger than the upper limit value (V0-V1)max of the normal value or smaller than the lower limit value (V0-V1)min of the normal value in Act 105, the failure determining circuit 410 shifts to Act 108 and determines that the paper-thickness detecting unit 124 is in failure.

The determination on whether the differential voltage V0-V1 is within the predetermined voltage range may be performed according to whether the voltage value V1 is within the predetermined voltage range. Alternatively, both the determinations may be performed, i.e., the determination on whether the voltage V1 is within the predetermined voltage range and the determination on whether the differential voltage V0-V1 is within the predetermined range may be performed.

When it is determined that the paper-thickness detecting unit 124 is in failure, in the next Act 109, the failure determining circuit 410 detects whether a paper type is set in advance. When a paper type during a failure is set in the paper-type-during-failure setting unit 122*a* shown in FIG. 3 in the MFP as described above, in Act 110, the failure determining circuit 410 sets a printing condition corresponding to the set paper type.

For example, it is assumed that the MFP is set in Japan and the paper-type-during-failure setting unit 122*a* selects the plain paper 1 as the setting of the paper type during a failure. In this case, in Act 107, in the same manner as the time when the plain paper 1 is selected, fixing processing for a toner image is performed at relatively low temperature. Further, it is assumed that the MFP is set outside Japan and the paper-type-during-failure setting unit 122*a* selects the plain paper 2 as the setting of the paper type during a failure. In this case, in Act 107, in the same manner as the time when the plain paper 2 is selected, fixing processing for a toner image is performed at relatively high temperature.

On the other hand, in Act 109, when the papery type during failure is not set in the paper-type-during-failure setting unit 122*a*, the failure determining circuit 410 shifts to Act 111. In this Act, the failure determining circuit 410 displays, for example, an indication "please select the plain paper 1 or the plain paper 2 as a paper type" on the display screen of the touch panel display 103 and causes the user to select the plain paper 1 or the plain paper 2.

When it is detected in Act 112 that the plain paper 1 or the plain paper 2 is selected, a printing condition corresponding to the selected paper type, i.e., the plain paper 1 or the plain paper 2 is set in Act 113. In Act 107, printing, i.e., fixing processing is performed under the condition.

In the embodiment described above, the paper-thickness detecting unit 124 detects whether the output voltage V0 and the differential voltage V0-V1 of the voltage detecting circuit 406 is within the predetermined voltage range and determines whether the paper-thickness detecting unit 124 is in failure. However, it is also possible to determine whether the paper-thickness detecting unit 124 is in failure according to whether the output voltage V0 before sheet insertion and the output voltage V1 after sheet insertion are within the predetermined voltage range.

In the embodiment, when a failure occurs, if the paper type during a failure is set in advance, the paper type is set. If the paper type during a failure is not set, the user selects a paper type when a failure occurs. However, when a failure occurs, it is also possible to estimate a type of paper printed immediately before the failure, continue printing under a printing condition corresponding to the paper type, and cause the user to select a paper type when a paper type immediately before the failure is not detected.

Another embodiment of the present invention is explained with reference to a flowchart shown in FIG. 12.

When the user cannot determine whether plain paper suitable for printing is the plain paper 1 or the plain paper 2, the user touches the icon P0 of the plain paper (automatic) on the display screen of the touch panel display 103 shown in FIG. 2. When the user touches the icon P0 of the plain paper (automatic), in Act 201, before the sheet 118 is conveyed to the paper-thickness detecting unit 124, the paper-thickness detecting unit 124 measures a detected voltage V0 before sheet insertion. In Act 202, the paper-thickness detecting unit 124 detects whether the detected voltage V0 before sheet insertion is within a predetermined voltage range. When the voltage V0 is within the predetermined voltage range, in Act 203, a sheet is inserted. In Act 204, the paper-thickness detecting unit 124 measures a detected voltage V1 after sheet insertion.

In Act 205, the paper-thickness detecting unit 124 determines whether the detected voltage V1 after sheet insertion is within the predetermined voltage range. When the detected voltage V1 is within the predetermined range, the paper-thickness detecting unit 124 shifts to Act 206. The paper-thickness detecting unit 124 detects paper thickness substantially proportional to the detected voltage V1 and sets a printing condition corresponding to the paper thickness. Thereafter, printing is performed in Act 207.

Figure 12:
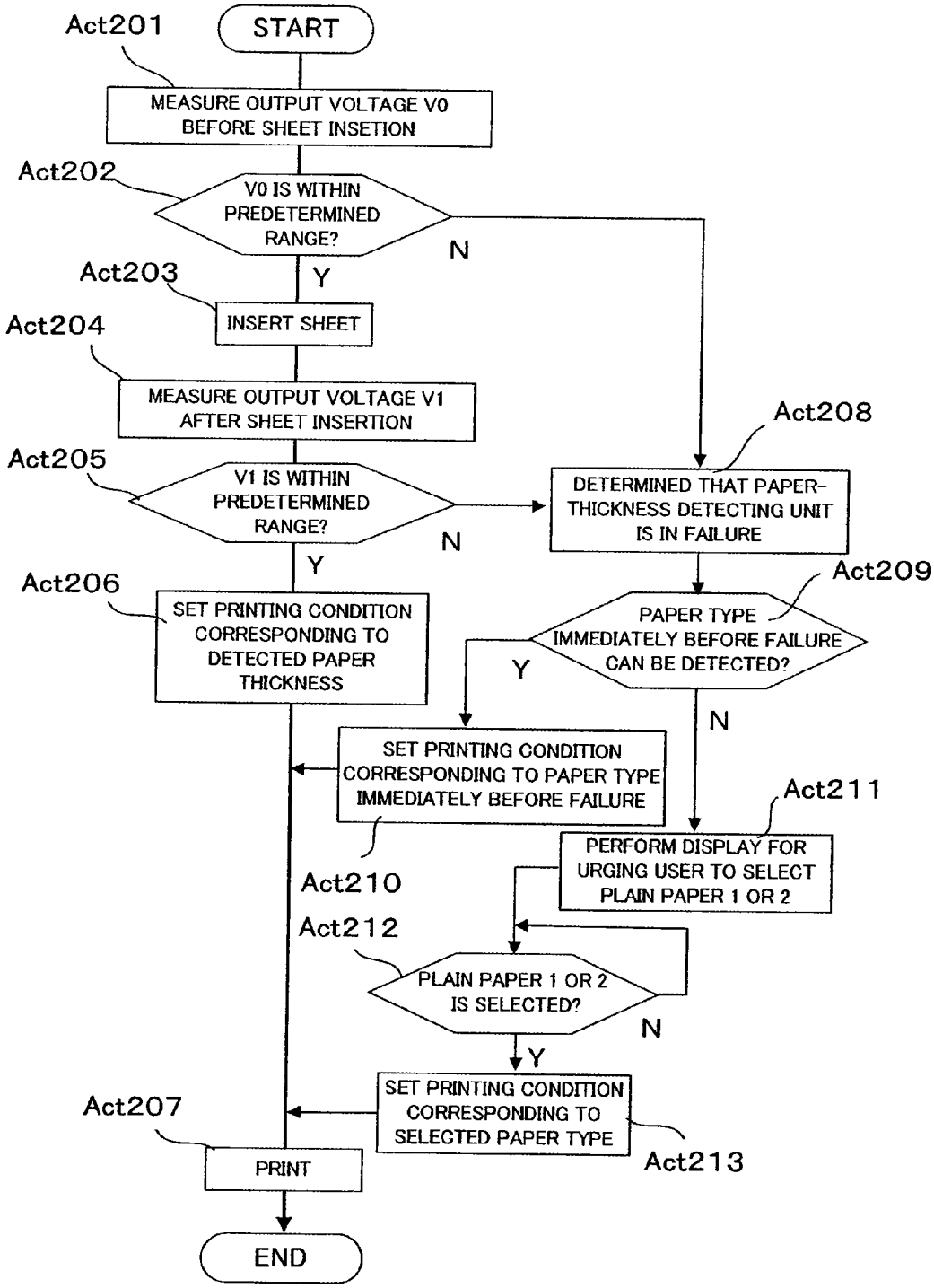
FIG. 12 is a flowchart for explaining operations according to another embodiment of the present invention.

In the flowchart shown in FIG. 12, the determination on whether the paper-thickness detecting unit 124 is in failure in from Act 202 to Act 208 and from Act 205 to Act 208 is performed by the failure-determining circuit 410.

When the voltage value V0 obtained before sheet insertion is not within the predetermined voltage range, the failure determining circuit 410 shifts to Act 208 and determines that the paper-thickness detecting unit 124 cannot detect paper thickness because of a failure or the like.

When the voltage value V1 is not within the predetermined voltage range, i.e., when the voltage value V1 is larger than the upper limit value V1max of the normal value or smaller than the lower limit value V1min of the normal value in Act 205, the failure determining circuit 410 also shifts to Act 208 and determines that the paper-thickness detecting unit 124 is in failure.

When it is determined that the paper-thickness detecting unit 124 is in failure, in the next Act 209, the failure determining circuit 410 determines whether a paper type immediately before the failure can be detected.

The paper type immediately before the failure can be determined because the sheet-supply control unit 123 shown in FIG. 3 recognizes from which paper feeding cassette a sheet is supplied immediately before the failure.

On the other hand, when the paper type immediately before the failure cannot be recognized in Act 209, the failure determining circuit 410 shifts to Act 211. In this Act, the failure determining circuit 410 displays an indication "please select the plain paper 1 or the plain paper 2 as a paper type" on the display screen of the touch panel display 103 and causes the user to select the plain paper 1 or the plain paper 2.

When it is detected in Act 212 that the plain paper 1 or the plain paper 2 is selected, in Act 213, a printing condition corresponding to the selected paper type, i.e., the plain paper 1 or the plain paper 2 is set. In Act 207, printing, i.e., fixing processing is performed under the condition.

According to this embodiment, a paper type immediately before a failure is detected by the sheet supplying unit 123 and printing is continued. Therefore, there is an advantage that a special circuit for, for example, checking a frequency of use of a sheet in the past when a failure occurs is unnecessary.

In the embodiment, the paper-thickness detecting device is used. However, in general, the present invention can be applied to an image forming apparatus having a paper-type detecting unit.

In the two embodiments described above, the output voltage V0 to the voltage detecting circuit 406 before sheet insertion into the paper-thickness detecting unit is primarily detected. When it is detected that the paper-thickness detecting unit is in failure at this stage, since failure detection is performed before sheet supply, it is possible to inform the user to that effect earlier. Therefore, there is an advantage that it is possible to earlier change not only a fixing condition but also other conditions such as a condition for forming a latent image and sheets are not wasted.

In the embodiments, as failure determination, after it is detected whether the voltage value V0 is within the predetermined voltage range, it is detected whether the differential voltage V0-V1 or the voltage value V1 is within the predetermined range. However, in the present invention, it is also possible to use only the detection on whether the voltage value V0 before sheet insertion is within the predetermined voltage range can be used for determination on a failure.

In the two embodiments, a paper type during a failure is set in advance or a paper type immediately before a failure is determined to set a printing condition and the like. However, it is also possible to cause the user to select in advance which of these methods is adopted when a failure occurs. Consequently, there is an advantage that it is possible to flexibly cope with a failure.

In the explanation of the embodiments, the present invention is applied to the multifunction color copying apparatus. However, the present invention can be applied not only to the multifunction color copying apparatus but also to other image forming apparatuses that have image generating units, which generate images printed on recording sheets, and designate a type of paper to be printed such as a normal copying machine, a printer, and a facsimile.

In the embodiments of the present invention, fixing temperature is changed according to whether a printed image is rough or is abnormally glossy or whether an image fades or is abnormally less glossy. However, in the present invention, directing attention only to the gloss, fixing temperature may be changed according to whether the gloss is large or small.

In the embodiments of the present invention, paper thickness is detected by the paper-thickness detecting unit having the specific configuration to estimate a paper type and perform printing. However, paper thickness may be detected by other apparatuses to estimate a paper type and perform printing.

Moreover, the present invention may be adapted to directly detect a paper type without detecting paper thickness and perform printing under a printing condition corresponding to the paper type. In short, if a paper-type detecting unit that can estimate a paper type and directly detect a paper type is provided, the object of the present invention can be attained.

In the explanation in the embodiments of the present invention, after a toner image is obtained, the toner image is transferred onto a sheet. However, the present invention can be applied when the toner image is not transferred but is formed on the sheet.

In the explanation in the embodiments of the present invention, fixing temperature in performing fixing of a transferred image is changed as a printing condition. However, the present invention can be applied when a printing condition other than the fixing temperature is changed.

Obviously, many modifications and variations of the present invention are possible in light of the above teachings. It is therefore to be understood that, within the scope of the appended claims, the present invention may be practiced otherwise than as specification.

What is claimed is:

1. An image forming apparatus having a paper-type detecting unit, comprising:

a paper-type detecting unit that detects a paper type of a sheet to be printed, the paper-type detecting unit detecting paper type as a differential voltage between an output voltage before sheet insertion and an output voltage after sheet insertion;

a fixing unit that sets fixing temperature on the basis of the paper type detected by the paper-type detecting unit and fixes a toner image on the sheet;

a paper-type-detection-failure determining unit that determines a failure if the output voltage before sheet insertion is outside a first predetermined voltage range, and, determines a failure if the output voltage before sheet insertion is within the first predetermined voltage range and the differential voltage is outside a second predetermined voltage range;

a paper-type-during-failure setting unit that sets in advance, according to a region, a paper type to be used as a paper type during a failure; and a condition-during-failure setting unit that sets, if the paper-type-detection-failure determining unit determines that the paper-type detecting unit is in failure, a printing condition for the paper type set by the paper-type-during-failure setting unit.

2. The apparatus according to claim 1, wherein the region is Japan or outside of Japan and, if the region is Japan, the fixing temperature that is set during fixing processing for a toner image as a printing condition is set lower than the fixing temperature that is set if the region is outside of Japan.

3. The apparatus according to claim 1, further comprising a paper-type selection urging unit that urges, if a paper type during a failure is not set in the paper-type-during-failure setting unit, the user to select a paper type if the paper-type detecting unit is in failure.

4. The apparatus according to claim 1, wherein the paper-type detecting unit is a paper-thickness detecting unit that measures paper thickness of the sheet.

5. The apparatus according to claim 4, wherein the paper-thickness detecting unit measures paper thickness as a differential voltage between an output voltage before the sheet is inserted and an output voltage after the sheet is inserted.

6. An image forming apparatus having a paper-type detecting unit, comprising:

a paper-type detecting unit that detects a paper type of a sheet to be printed, the paper-type detecting unit detecting paper type as a differential voltage between an output voltage before sheet insertion and an output voltage after sheet insertion;

a fixing unit that sets fixing temperature on the basis of the paper type detected by the paper-type detecting unit and fixes a toner image on the sheet;

a paper-type-detection-failure determining unit that determines a failure if the output voltage before sheet insertion is outside a first predetermined voltage range, and determines a failure if the output voltage before sheet insertion is within the first predetermined voltage range and the differential voltage is outside a second predetermined voltage range; and a printing-during-failure continuing unit that determines, if the paper-type-detection-failure determining unit determines that the paper-type detecting unit is in failure, that the paper type is a paper type of a sheet printed immediately before the failure and continues a printing condition.

7. The apparatus according to claim 6, wherein the paper type of the sheet printed immediately before the failure is determined according to a paper feeding cassette from which the sheet is supplied.

8. The apparatus according to claim 7, further comprising a paper-type selection urging unit that urges, if a paper type of a sheet printed immediately before a failure cannot be determined by the printing-during-failure continuing unit, the user to select a paper type if the paper-type detecting unit is in failure.

9. The apparatus according to claim 8, wherein the paper-type detecting unit is a paper-thickness detecting unit that measures paper thickness of the sheet.

10. The apparatus according to claim 9, wherein the paper-thickness detecting unit measures paper thickness as a differential voltage between an output voltage before the sheet is inserted and an output voltage after the sheet is inserted.

11. An image forming method using a paper-type detecting unit, comprising:

setting in advance, according to a region, a paper type to be used during a paper-type-detecting-failure;

detecting a paper type of a sheet to be printed as a differential voltage between an output voltage before sheet insertion and an output voltage after sheet insertion;

setting a fixing temperature on the basis of the paper type detected and fixing a toner image on the sheet;

determining a failure if the output voltage before sheet insertion is outside a first predetermined voltage range;

determining a failure if the output voltage before sheet insertion is within the first predetermined voltage range and the differential voltage is outside a second predetermined voltage range; and setting, if determining that the paper-type detecting is in failure, a printing condition for the paper type to be used during a paper-type-detecting failure.

* * * * *